US006075491A

United States Patent [19]

Dakeya et al.

[11] Patent Number: 6,075,491

[45] **Date of Patent: *Jun. 13, 2000**

[54] CHIP ANTENNA AND MOBILE COMMUNICATION APPARATUS USING SAME

[75] Inventors: Yujiro Dakeya, Omihachiman; Teruhisa Tsuru, Kameoka; Seiji Kanba, Otsu; Tsuyoshi Suesada, Shiga-ken, all of Japan

[73] Assignee: Murata Manufacturing Co., Ltd., Japan

[ * ] Notice: This patent is subject to a terminal disclaimer.

[21] Appl. No.: 09/078,850

[22] Filed: May 14, 1998

[30] Foreign Application Priority Data

May 15, 1997 [JP] Japan ..... 9-125787
Apr. 20, 1998 [JP] Japan ..... 10-109484

[51] Int. Cl.[7] ..... H01Q 1/38

[52] U.S. Cl. ..... 343/722; 343/702; 343/700 MS

[58] Field of Search ..... 343/700 MS, 702, 343/722

[56] References Cited

U.S. PATENT DOCUMENTS 5,585,810 12/1996 Tsuru et al. ..... 343/745
5,952,970 9/1999 Kawahata ..... 343/700 MS

FOREIGN PATENT DOCUMENTS 0762538 3/1997 European Pat. Off. .
0764999 3/1997 European Pat. Off. .
8-186420 7/1996 Japan .

*Primary Examiner*—Don Wong
*Assistant Examiner*—James Clinger
*Attorney, Agent, or Firm*—Ostrolenk, Faber, Gerb & Soffen, LLP

[57] ABSTRACT

A chip antenna 10 includes, inside a rectangular-parallelepiped base 11 having barium oxide, aluminum oxide, and silica as main constituents, a conductor 12 wound in a spiral form along the length direction of the base 11, and an LC parallel resonance circuit 13, which is inserted in the intermediate portion of the conductor 12 and which is connected electrically in series with the conductor 12, and includes, on the surface of the base 11, a power-feeding terminal 14 for applying a voltage to the conductor 12. The conductor 12 is separated into a first conductor 121 and a second conductor 122 by the LC parallel resonance circuit 13. The LC parallel resonance circuit 13 is formed of a coil L1, which is an inductance element, and a capacitor C1, which is a capacitance element, which are connected in parallel.

5 Claims, 6 Drawing Sheets

CHIP ANTENNA AND MOBILE COMMUNICATION APPARATUS USING SAME

BACKGROUND OF THE INVENTION

1. Field of the Invention

The present invention relates to a chip antenna and, more particularly, to a chip antenna for use in a mobile communication apparatus, such as a PHS (Personal Handy-phone System) or a portable telephone set using the chip antenna.

2. Related Art of the Invention

A print antenna which has a plurality of resonance frequencies and which can be used at a plurality of frequencies at the same time has been proposed in Japanese Unexamined Patent Publication No. 8-186420. FIG. 11 shows a conventional print antenna having a plurality of resonance frequencies, which can be used for two frequencies. A print antenna 50 is formed of a dielectric substrate 52 on which a monopole element 51 whose one end is connected to a power source V is printed. An anti-resonance circuit 54, which is a parallel circuit of a chip inductor 53*a* and a chip capacitor 53*b*, is inserted in the intermediate portion of the monopole element 51, and the monopole element 51 is separated into a first antenna element 51*a* and a second antenna element 51*b*. The monopole element 51 resonates at a first frequency f1 (wavelength: $\lambda 1$), and the length of the monopole element 51 at this time is approximately $1/4\lambda$. Also, the anti-resonance circuit 54 resonates at a second frequency f2 (wavelength: $\lambda 2$). Further, since the first antenna element 51*a* is made to singly resonate at the second frequency f2, the length thereof is set at approximately $2/4\lambda$. Since the anti-resonance circuit 54 resonates at the second frequency f2, the print antenna constructed as described above becomes equivalent to a state in which with respect to the second frequency f2, the second antenna element 51*b* is opened, and resonates at the first frequency f1 and also the second frequency f2. Thus, the print antenna has two resonance frequencies.

The band width of the first and second frequencies f1 and f2 is determined by the width of the first and second antenna elements 51*a* and 51*b*. An increase in the width makes it possible to increase the band width of the first and second frequencies f1 and f2.

However, according to the above-described conventional print antenna, if an attempt to realize a wider band is made, the width of the first and second antenna elements must be increased, causing the print antenna to become enlarged, as a result, presenting the problem that it is difficult to form the mobile communication apparatus which mounts this print antenna into a smaller size.

SUMMARY OF THE INVENTION

An object of the present invention is to provide a small chip antenna having a plurality of resonance frequencies a mobile communication apparatus using the chip antenna, which overcome the above described problems and the other problems of the prior art antennas.

The present invention provides a chip antenna, comprising: a base comprising at least one of a dielectric material and a magnetic material; at least one conductor provided at least one of within the base and on the surface of the base; and an anti-resonance circuit inserted in the intermediate portion of said conductor and electrically connected in series; and a power-feeding terminal provided on the surface of said base and electrically connected to one end of said conductor.

According to the above chip antenna, since there is provided an anti-resonance circuit, which is inserted into an intermediate portion of the conductor and which is connected electrically in series, the conductor resonates at the frequency corresponding to the length of the conductor. With respect to the frequency at which the anti-resonance circuit resonates, the state is reached which is equivalent to that in which from the position of the conductor at which the anti-resonance circuit is connected to the other end is opened. If the length from one end of the conductor to the position at which the anti-resonance circuit is connected is set so that the conductor resonates at the frequency at which the anti-resonance circuit resonates, this chip antenna can have as resonance frequencies a frequency corresponding to the length of the conductor and a frequency corresponding to the length from one end of the conductor to the position at which the anti-resonance circuit is connected.

Therefore, it is possible to realize an antenna having a plurality of resonance frequencies by one chip antenna. As a result, this can be used, for example, as a winding-up antenna for a portable telephone set, an antenna in which both transmission and reception are shared, and the like.

By setting the total length of the conductor, and the length from the power-feeding terminal to the position at which the anti-resonance circuit is connected at any desired value, it is possible to set two resonance frequencies at any desired values. Therefore, this antenna can serve any desired mobile communication apparatus, and the like.

Further, since the band width of a plurality of frequencies is determined by a stray capacitance generated between the conductor of the chip antenna and a ground of the mobile communication apparatus mounting the chip antenna, it is possible to realize a small chip antenna having a wide band width without enlarging the chip antenna itself.

In the above described chip antenna, said anti-resonance circuit may be an LC parallel resonance circuit comprising an inductance element and a capacitance element.

According to the above chip antenna, it is possible to house the inductance element and the capacitance element within the base, comprising at least one of the dielectric material and the magnetic material, which forms the chip antenna, or to mount it. Therefore, it is possible to form the chip antenna having a plurality of resonance frequencies into a smaller size.

In the above described chip antenna, at least one of the inductance element and the capacitance element which constitutes said anti-resonance circuit may be a variable element.

According to the above chip antenna, it is possible to adjust the resonance frequency of the LC parallel resonance circuit by adjusting the value of the variable element, and as a result, it is possible to obtain a chip antenna having satisfactory antenna characteristics.

In the above described chip antenna, said anti-resonance circuit may be mounted within said base.

According to the above chip antenna, it is possible to form the chip antenna into a smaller size, the aging of the anti-resonance circuit is decreased, and the durability is increased, making it possible to enhance the reliability of the chip antenna.

The present invention further provides a mobile communication apparatus, comprising: the above described chip antenna; a transmission circuit connected to said chip antenna; a receiving circuit connected to said chip antenna; and a housing which covers said chip antenna, said transmission circuit and said receiving circuit.

According to the above mobile communication apparatus, since the above described chip antenna having a plurality of resonance frequencies is used, it is possible for one antenna to transmit and receive radio waves at a plurality of different frequencies. Therefore, it is possible to form the mobile communication apparatus into a smaller size.

Other features and advantages of the present invention will become apparent from the following description of the invention which refers to the accompanying drawings.

PREFERRED EMBODIMENTS OF THE PRESENT INVENTION

Figure 1:
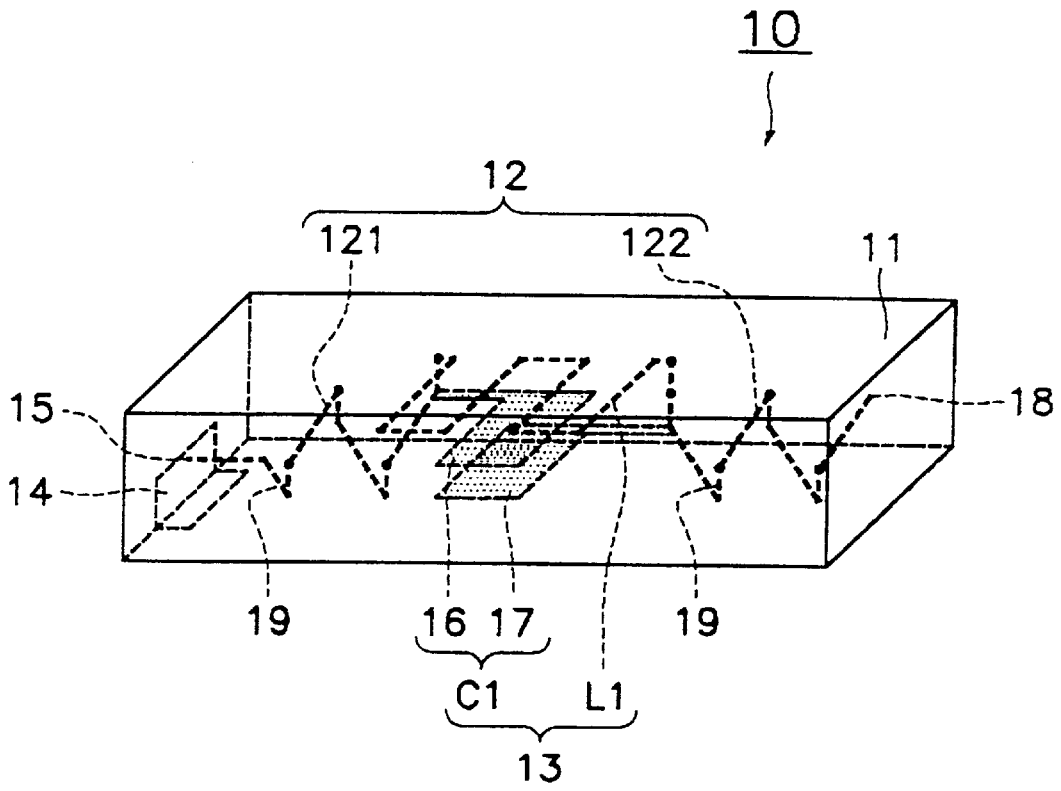
FIG. 1 is a see-through perspective view of a first embodiment of a chip antenna according to the present invention.
Figure 2:
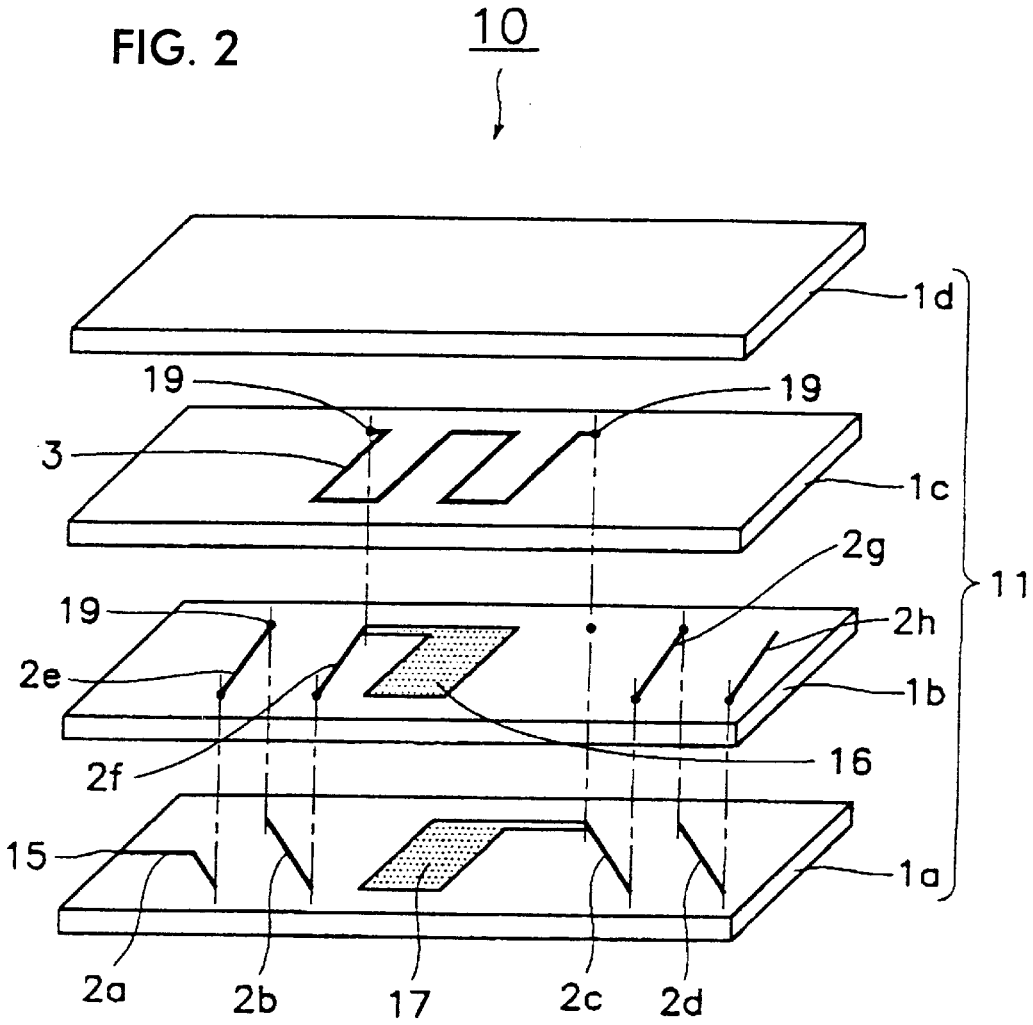
FIG. 2 is an exploded perspective view of the chip antenna of FIG. 1.

FIGS. 1 and 2 are a see-through perspective view and an exploded perspective view of a first embodiment of a chip antenna according to the present invention. A chip antenna 10 comprises, within a base 11 having barium oxide, aluminum oxide, and silica as main constituents, a conductor 12 wound in a spiral form along the length direction of the base 11, and an LC parallel resonance circuit 13, which is an anti-resonance circuit inserted in the intermediate portion of the conductor 12 and connected electrically in series with the conductor 12, and also comprises a power-feeding terminal 14 for applying a voltage to the conductor 12 on the surface of the base 11.

The conductor 12 is separated into a first conductor 121 and a second conductor 122 by the LC parallel resonance circuit 13. Also, the LC parallel resonance circuit 13 is formed of a coil L1, which is an inductance element, and a capacitor C1, which is a capacitance element, which are connected in parallel.

One end of the first conductor 121, which is one end of the conductor 12, is extended out on the end surface of the base 11, forming a power-supply section 15, and is connected to the power-feeding terminal 14. Further, the other end of the first conductor 121 is connected to one end of the coil L1 and a capacitor electrode 16 which forms the capacitor C1 inside the base 11. Further, one end of the second conductor 122 is connected to the other end of the coil L1 and a capacitor electrode 17 which forms the capacitor C1. Further, the other end of the second conductor 122, which is the other end of the conductor 12, forms a free end 18 inside the base 11. With such a construction, the conductor 12 formed of the first and second conductors 121 and 122, and the LC parallel resonance circuit 13 become connected in series with each other.

The base 11 is formed in such a way that rectangular sheet layers 1*a* to 1*d* formed of a dielectric material (relative dielectric constant: about 6.0) having barium oxide, aluminum oxide, and silica as main constituents are multilayered. Of these layers, on the surfaces of the sheet layers 1*a* and 1*b*, there is provided conductive patterns 2*a* to 2*h*, which are formed of copper or a copper alloy and formed nearly in the shape of a letter L or nearly in a linear shape by printing, vapor deposition, bonding, or plating, and capacitor electrodes 16 and 17 which are formed nearly in a rectangular shape.

Further, on the surface of the sheet layer 1*c*, there is provided a meandering-shaped coil electrode 3, which is formed of copper or a copper alloy by printing, vapor deposition, bonding, or plating and which forms the coil L1. Further, viaholes 19 are provided in the thickness direction at predetermined positions (at both ends of conductive patterns 2*e* and 2*g*, one end of conductive patterns 2*f* and 2*h*, and both ends of the coil electrode 3) of the sheet layers 1*b* and 1*c*.

Then, by sintering the sheet layers 1*a* to 1*d* in layers and connecting the conductive patterns 2*a*, 2*b*, 2*e*, and 2*f* by the viahole 19, and connecting the conductive patterns 2*c*, 2*d*, 2*g*, and 2*h* by the viahole 19, a conductor 12, formed of the first and second conductors 121 and 122 wound in a spiral form, is formed along the length direction of the base 11 within the base 11. The axial direction of the spiral conductors 121 and 122 are substantially perpendicular to the stacking direction of the sheet layers 1*a* through 1*d*.

Figure 3:
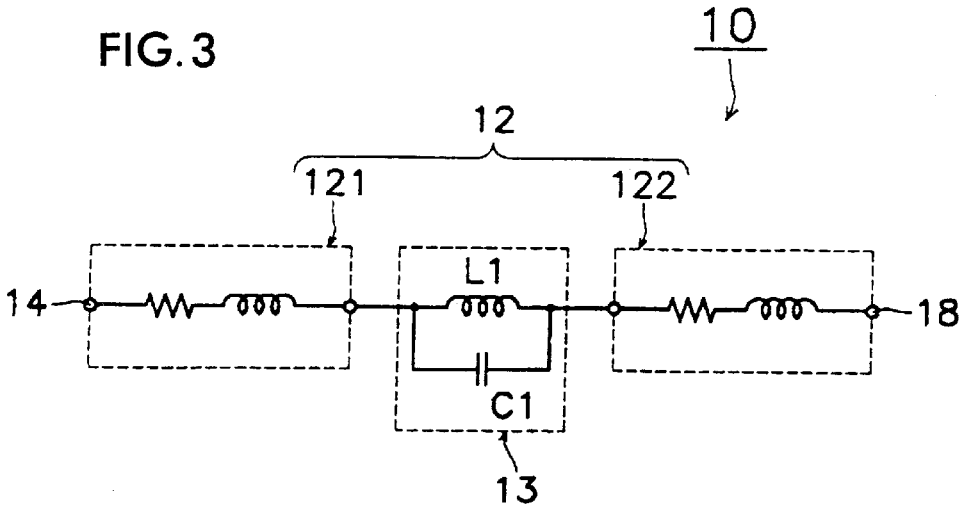
FIG. 3 is an equivalent circuit diagram of the chip antenna of FIG. 1.

FIG. 3 shows an equivalent circuit diagram of the chip antenna 10 of FIG. 1. The chip antenna 10 comprises the conductor 12 formed of the first and second conductors 121 and 122 such that resistance components and inductance components are connected in series, and the LC parallel resonance circuit 13 such that the coil L1 and the capacitor C1 are connected in parallel.

One end of the first conductor 121 is connected to the power-feeding terminal 14, and the other end is connected to one end of the LC parallel resonance circuit 13. Further, one end of the second conductor 122 is connected to the other end of the LC parallel resonance circuit 13, and the other end forms the free end 18.

In the chip antenna 10 having this construction, the conductor 12 resonates at the first frequency f1. Also, with respect to the second frequency f2 at which the LC parallel resonance circuit 13 resonates, the state is reached which is equivalent to that in which from the position of the conductor 12 at which the LC parallel resonance circuit 13 is connected to the other end, that is, the second conductor 122, is opened. If the length from one end of the conductor 12 to the position at which the LC parallel resonance circuit 13 is connected, that is, the length of the first conductor 121, is set so that the first conductor 121 resonates at the second frequency f2, the first conductor 121 resonates at the second frequency f2.

As a result, the chip antenna 10 can have as resonance frequencies the first frequency f1 corresponding to the length of the conductor 12 and the second frequency f2 corresponding to the length of the first conductor 121.

Table 1 shows f1, f2, f2−f1, BWa, and BWb in three types of the chip antenna 10 such that the length d1 of the conductor 12 and the length d2 of the first conductor 121 are varied, respectively, where BWa and BWb are a band width of the first and second frequencies f1 and f2, respectively, when the voltage standing wave ratio=2.

TABLE 1

| | | | | | | VSWR = 2 | |
|---|---|---|---|---|---|---|---|
| Sample No. | d1 [mm] | d2 [mm] | f1 [MHz] | f2 [MHz] | f1–f2 [MHz] | BWa [MHz] | BWb [MHz] |
| 1 | 94 | 89 | 812.8 | 866.8 | 54.0 | 15.7 | 16.3 |
| 2 | 90 | 79 | 874.0 | 964.0 | 90.0 | 17.0 | 20.6 |
| 3 | 96 | 80 | 790.0 | 953.0 | 163.0 | 15.4 | 18.0 |

Figure 4:
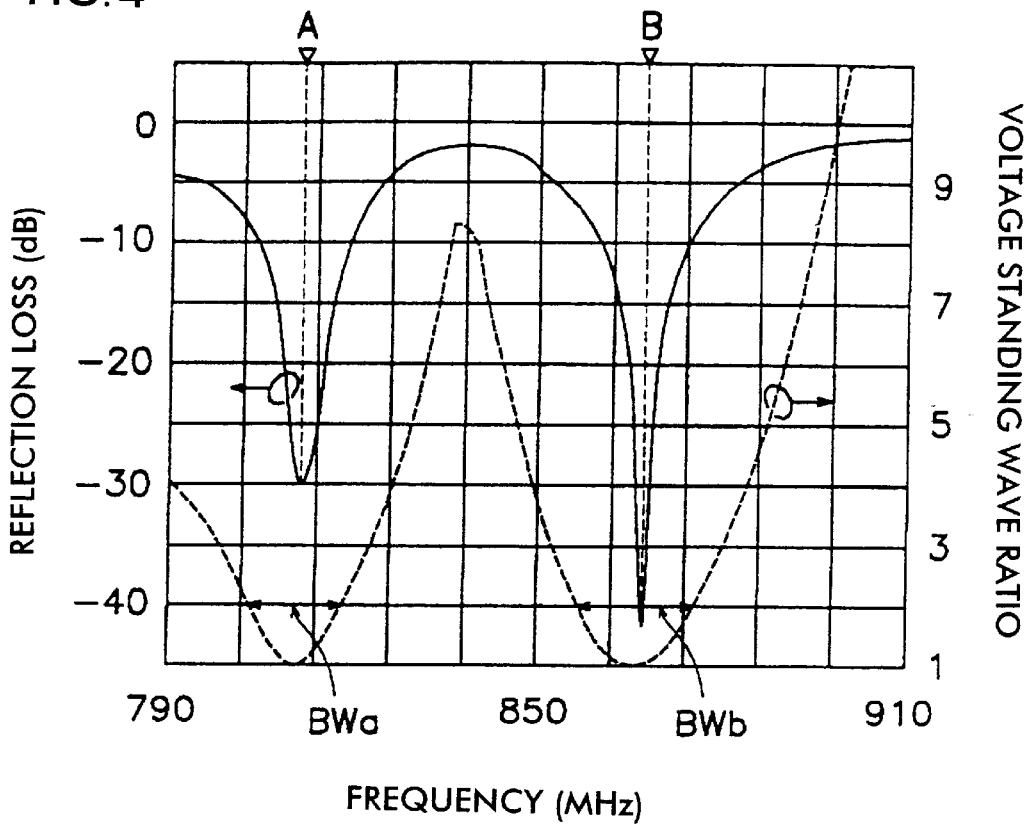
FIG. 4 is a view showing the reflection loss and the voltage standing wave ratio of the chip antenna of FIG. 1.

FIG. 4 shows the reflection loss and the voltage standing wave ratio of the chip antenna 10 of sample No. 1 in Table 1. In FIG. 4, the solid line indicates the reflection loss, the broken line indicates the voltage standing wave ratio, and point A and point B (▽ marks in FIG. 4) indicate the resonance frequency.

It can be seen from Table 1 and FIG. 4 that as a result of connecting the LC parallel resonance circuit 13, which is an anti-resonance circuit, in series with the conductor 12, the chip antenna 10 has two resonance frequencies. That is, it can be seen that an antenna having two different resonance frequencies by one chip antenna 10 can be realized.

Further, by setting the length d1 from one end of the conductor 12, which is the power-supply section 15, to the other end, which is the free end 18, and the length d2 from one end of the first conductor 121 to the other end at any desired values, it is possible to set two resonance frequencies at any desired values.

The band width of the first and second frequencies f1 and f2 is determined by a stray capacitance generated between the conductor 12 of the chip antenna 10 and a ground (not shown) of a mobile communication apparatus mounting the chip antenna 10. By increasing the stray capacitance, it is possible to increase the band width of the first and second frequencies f1 and f2.

Figure 5:
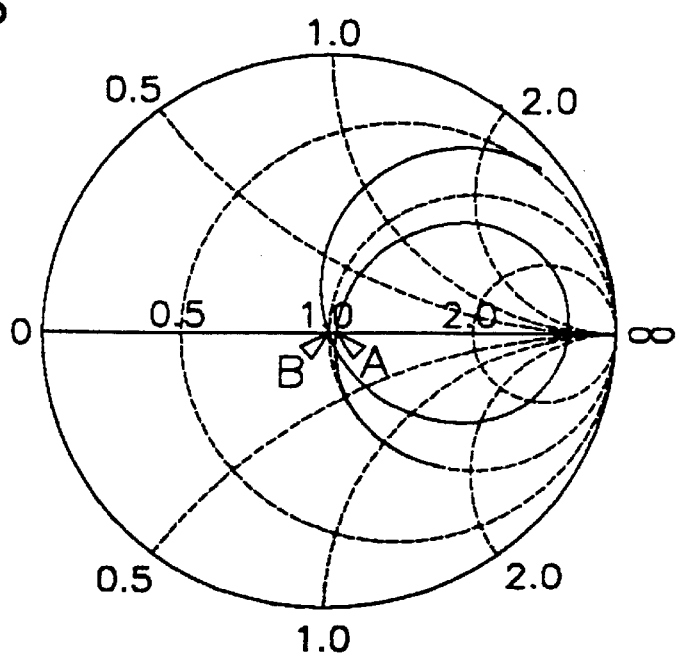
FIG. 5 is a view showing the input impedance of the chip antenna of FIG. 1.

FIG. 5 shows the input impedance characteristics of the antenna apparatus 10 shown in FIG. 1. It can be seen from this figure that at two resonance frequencies 812.8 MHz (point A) and 866.8 MHz (point B), the ratio of the input impedance of the chip antenna 10 to the characteristic impedance of a high-frequency circuit section of a mobile communication apparatus and the like mounting the chip antenna 10 becomes 1.09 and 0.99, respectively, and the input impedance of the chip antenna 10 nearly coincides with the characteristic impedance of a high-frequency circuit section of a mobile communication apparatus and the like mounting the chip antenna 10. That is, it can be seen that a matching circuit for adjusting impedance is not required.

Figure 6:
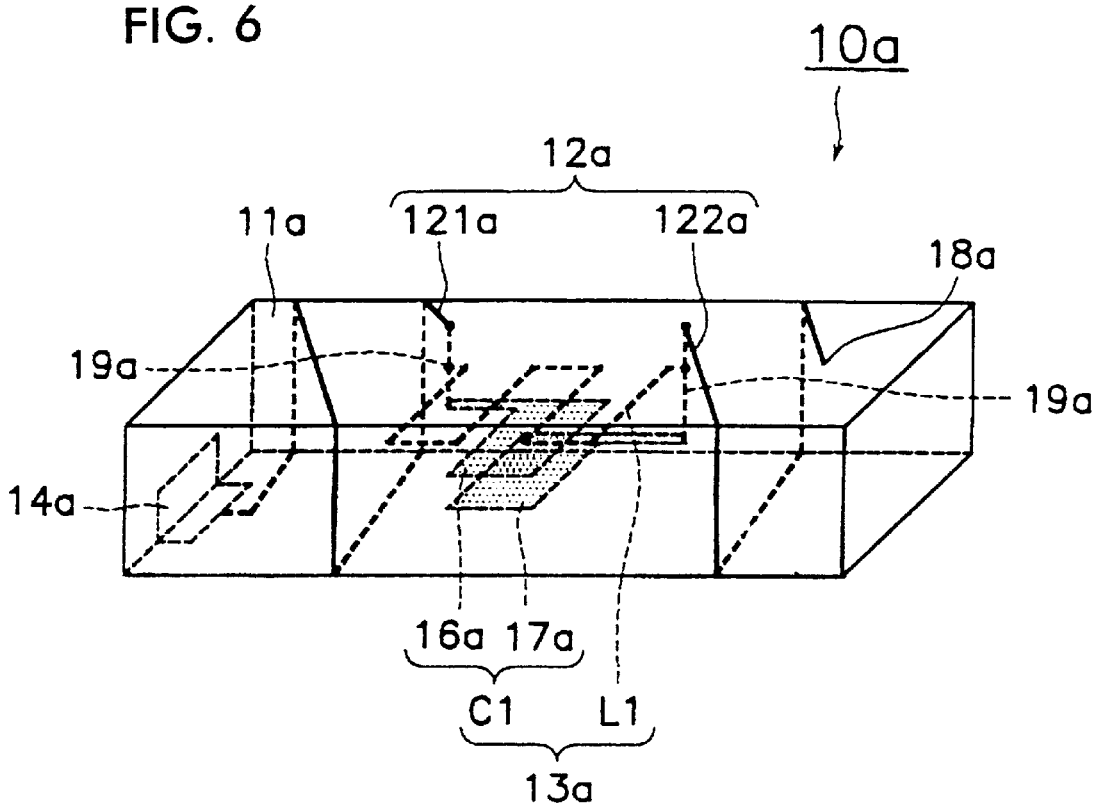
FIG. 6 is a see-through perspective view showing a modification of the chip antenna of FIG. 1.
Figure 7:
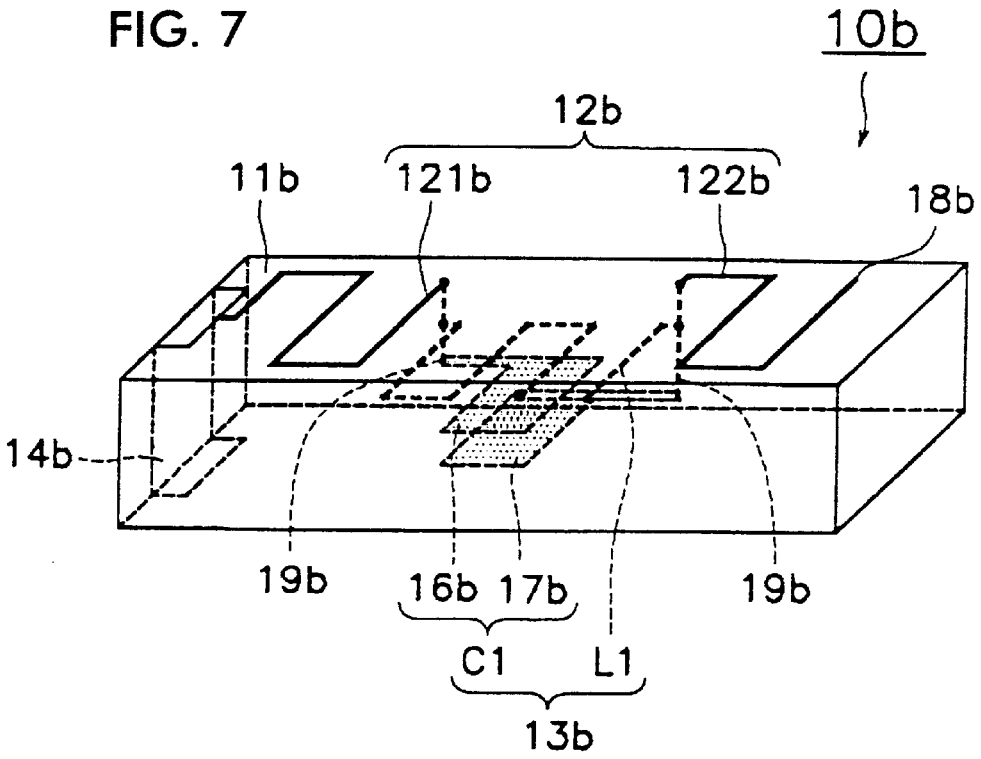
FIG. 7 is a see-through perspective view showing another modification of the chip antenna of FIG. 1.

FIGS. 6 and 7 show see-through perspective views of modifications of the chip antenna 10 of FIG. 1. A chip antenna 10*a* of FIG. 6 comprises a rectangular-parallelepiped base 11*a*, a conductor 12*a* wound in a spiral form along the length direction of the base 11*a* on the surface of the base 11*a*, an LC parallel resonance circuit 13*a*, which is inserted in the intermediate section of the conductor 12*a* and connected electrically in series with the conductor 12*a* and which is formed inside the base 11*a*, and a power-feeding terminal 14*a*, formed on the surface of the base 11*a*, for applying a voltage to the conductor 12*a*.

The conductor 12*a* is separated into a first conductor 121*a* and a second conductor 122*a* by the LC parallel resonance circuit 13*a*. The LC parallel resonance circuit 13*a* is formed of a coil L1 and a capacitor C1, which are connected in parallel.

One end of the first conductor 121*a* is connected to the power-feeding terminal 14*a* on the surface of the base 11*a*, and the other end of the first conductor 121*a* is connected to one end of the coil L1 and a capacitor electrode 16*a* which forms the capacitor C1 via a viahole 19*a*. Further, one end of the second conductor 122*a* is connected to the other end of the coil L1 and a capacitor electrode 17*a* which forms the capacitor C1 via the viahole 19*a*, and the other end of the second conductor 122*a* forms a free end 18*a* on the surface of the base 11*a*.

In this case, since the conductor 12*a* formed of the first and second conductors 121*a* and 122*a* can be formed easily by screen printing and the like on the surface of the base 11*a*, the manufacturing step of the chip antenna 10*a* can be simplified.

A chip antenna 10*b* of FIG. 7 comprises a rectangular-parallelepiped base 11*b*, a conductor 12*b* formed in a meandering shape on the surface (one main surface) of the base 11*b*, an LC parallel resonance circuit 13*b*, which is inserted in the intermediate portion of the conductor 12*b* and connected electrically in series with the conductor 12*b* and which is formed inside the base 11*b*, and a power-feeding terminal 14*b*, formed on the surface of the base 11*b*, for applying a voltage to the conductor 12*b*.

The conductor 12*b* is separated into a first conductor 121*b* and a second conductor 122*a* by the LC parallel resonance circuit 13*b*. The LC parallel resonance circuit 13*a* is formed of a coil L1 and a capacitor C1, which are connected in parallel.

One end of the first conductor 121*b* is connected to the power-feeding terminal 14*b* on the surface of the base 11*b*, and the other end of the first conductor 121*b* is connected to one end of the coil L1 and a capacitor electrode 16*b* which forms the capacitor C1 via a viahole 19*b*. Further, one end of the second conductor 122*b* is connected to the other end of the coil L1 and a capacitor electrode 17*b* which forms the capacitor C1 via the viahole 19*b*, and the other end of the second conductor 122*b* forms a free end 18*b* on the surface of the base 11*b*.

In this case, since the conductor having a meandering shape is formed only on one main surface of the base, a lower height of the base can be achieved, consequently also achieving a lower height of the antenna main unit. The conductor having a meandering shape may also be provided within the base.

According to the above-described chip antenna of the first embodiment, since there is provided an anti-resonance circuit, which is inserted in an intermediate portion of a conductor and connected electrically in series, the conductor resonates at a first frequency. With respect to a second frequency at which the anti-resonance circuit resonates, the state is reached which is equivalent to that in which from the position of the conductor at which the anti-resonance circuit is connected to the other end, that is, a second conductor, is opened. If the length from one end of the conductor to the position at which the anti-resonance circuit of the conductor is connected, that is, the length of the first conductor, is set so that the first conductor resonates at the second frequency, this chip antenna can have the first frequency corresponding to the length of the conductor and a second frequency corresponding to the length of the first conductor as resonance frequencies.

Therefore, it is possible to realize an antenna having two different resonance frequencies by one chip antenna. As a result, this can be used, for example, for a winding-up antenna for a portable telephone set, and an antenna in which transmission and reception are shared.

By setting the total length of the conductor, and the length from the power-feeding terminal to the position at which the anti-resonance circuit is connected, that is, the length of the first conductor, at any desired value, it is possible to set two resonance frequencies at any desired values.

Further, since the anti-resonance circuit is formed of an LC parallel resonance circuit, it is possible to house the anti-resonance circuit within a base formed of a dielectric material, which forms the chip antenna, or to mount it.

Since the band width of the first and second frequencies is determined by a stray capacitance generated between the conductor of the chip antenna and the ground of the mobile communication apparatus mounting the chip antenna, it is possible to realize a small chip antenna having a wide band width without enlarging the chip antenna itself.

Further, since the anti-resonance circuit is mounted within the base, a smaller size of the chip antenna can be achieved, the aging of the anti-resonance circuit is decreased, and the durability is increased, making it possible to enhance the reliability of the chip antenna.

As in the chip antenna of the first embodiment, since the capacitance element which forms the anti-resonance circuit is mounted within the base as a capacitor electrode, the variable range of the capacitance value of the capacitance element is increased. Therefore, it is possible to increase the variable range of the second frequency.

Further, as in the chip antenna of the first embodiment, since the inductance element and the capacitance element which form the anti-resonance circuit are mounted as a coil electrode and as a capacitor electrode within the base, respectively, a fine adjustment of the inductance value of the inductance element and the capacitance value of the capacitance element is possible at the design stage, and the first and second frequencies can be determined with high accuracy at the design stage.

Figure 8:
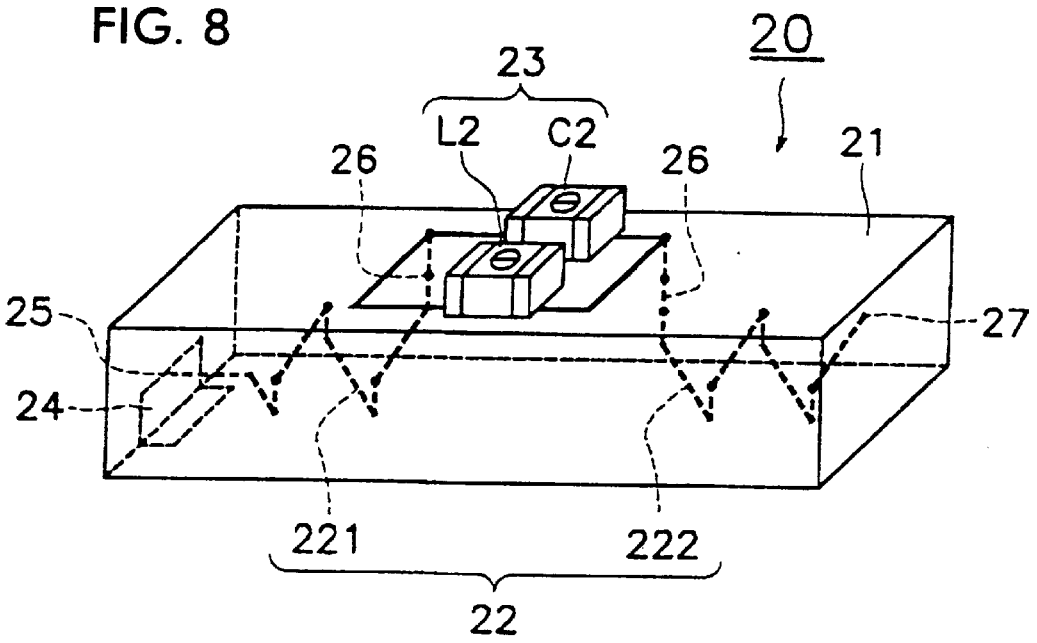
FIG. 8 is a see-through perspective view of a second embodiment of a chip antenna of the present invention.

FIG. 8 shows a see-through perspective view of a second embodiment of a chip antenna according to the present invention. A chip antenna 20 comprises, within a rectangular-parallelepiped base 21 having barium oxide, aluminum oxide, and silica as main constituents, a conductor 22 wound in a spiral form along the length direction of the base 21, comprises, on the surface (one main surface) of the base 21, an LC parallel resonance circuit 23, which is inserted in the intermediate portion of the conductor 22 and which is connected electrically in series with the conductor 22, and comprises, on the surface of the base 11, a power-feeding terminal 24 for applying a voltage to the conductor 22.

The conductor 22 is separated into a first conductor 221 and a second conductor 22 by the LC parallel resonance circuit 23. The LC parallel resonance circuit 23 is formed of a variable chip coil L2, which is an inductance element, and a variable chip capacitor C2, which is a capacitance element, which are connected in parallel.

One end of the first conductor 221, which is one end of the conductor 22, is extended out on the end surface of the conductor 21, forming a power-supply section 25, and is connected to the power-feeding terminal 24. Further, the other end of the first conductor 221 is connected to one end of the variable chip coil L2 and one end of the variable chip capacitor C2 via a viahole 26. Further, one end of the second conductor 222 is connected to the other end of the variable chip coil L2 and the other end of the variable chip capacitor C2 via the viahole 26. Further, the other end of the second conductor 222, which is the other end of the conductor 22, forms a free end 27 inside the base 21. With such a construction, the conductor 22 formed of the first and second conductors 211 and 222, and the LC parallel resonance circuit 23 become connected in series with each other.

The equivalent circuit of the chip antenna 20 of FIG. 8 is the same as in the case of the chip antenna 10 of FIG. 1, which is shown in FIG. 3.

Table 2 shows a gain of the chip antenna 20 in the case when the inductance value of the variable chip coil L2 which forms the LC parallel resonance circuit 23 is fixed to 3.0 nH, and the capacitance value of the variable chip capacitor C2 is set at 5.0 to 25.0 pF.

The length from one end of the first conductor 221 of the chip antenna 20 to the other end is about 100 mm, and the frequency at which the first conductor 221 resonates is approximately 750 MHz. In Table 2, f2 is a calculated value of the second frequency at which the LC parallel resonance circuit 23 resonates, which is determined by the inductance value of the variable chip coil L2 and the capacitance value of the variable chip capacitor C2.

TABLE 2

| L [nH] | C [pF] | f [MHz] | Gain [dBd] |
|---|---|---|---|
| 3.0 | 5.0 | 1299.5 | −20.3 |
| 3.0 | 10.0 | 918.9 | −9.2 |
| 3.0 | 15.0 | 750.3 | −3.5 |
| 3.0 | 20.0 | 649.7 | −6.3 |
| 3.0 | 25.0 | 581.2 | −11.0 |

It can be seen from this Table 2 that when the second frequency f2 at which the LC parallel resonance circuit 23 resonates nearly coincides with the frequency at which the first conductor 221 resonates (L=3.0 [nH], C=15.0 [pF]), the gain of the chip antenna reaches a maximum. That is, by adjusting the capacitance value of the variable chip capacitor C2, the second frequency f2 at which the LC parallel resonance circuit 23 resonates can be adjusted, and as a result, it is possible to obtain a chip antenna whose antenna characteristics become most satisfactory when the second frequency f2 at which the LC parallel resonance circuit 23 resonates coincides with the frequency at which the first conductor 221 resonates.

This is due to the fact that when the frequency at which the LC parallel resonance circuit 23 resonates coincides with the frequency at which the first conductor 221 resonates, the LC parallel resonance circuit 23 does not hinder the resonance of the first conductor 221.

According to the chip antenna of the above-described second embodiment, since a variable chip capacitor is used as the capacitance element which forms the LC parallel resonance circuit, the second frequency at which the LC parallel resonance circuit resonates can be adjusted by adjusting the capacitance value of the variable chip capacitor. As a result, it is possible to obtain a chip antenna whose antenna characteristics become most satisfactory when the second frequency at which the LC parallel resonance circuit resonates coincides with the frequency at which the first conductor resonates.

Figure 9:
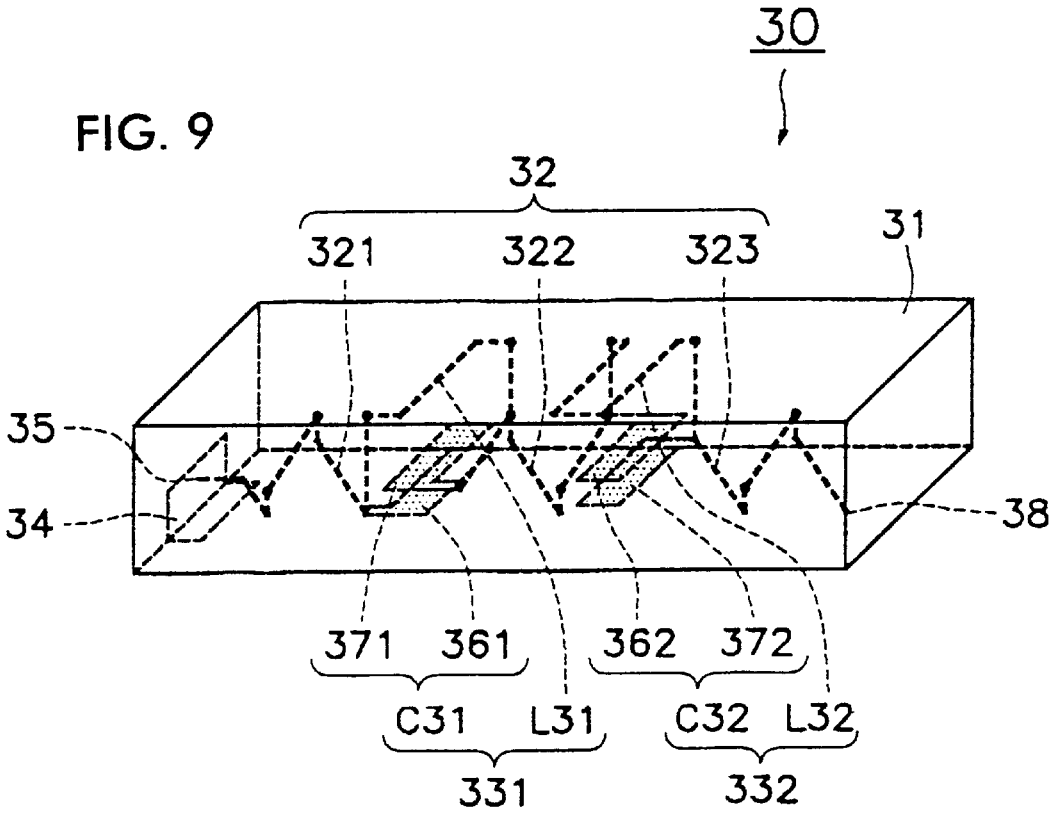
FIG. 9 is a see-through perspective view of a third embodiment of a chip antenna of the present invention.

FIG. 9 shows a see-through perspective view of a third embodiment of a chip antenna according to the present invention. A chip antenna 30 comprises, within a rectangular-parallelepiped base 31 having barium oxide, aluminum oxide, and silica as main constituents, a conductor 32 wound in a spiral form along the length direction of the base 31, and first and second LC parallel resonance circuits 331 and 332, which are inserted in the intermediate portion of the conductor 32 and which are connected electrically in series with the conductor 32, and comprises, on the surface of the base 31, a power-feeding terminal 34 for applying a voltage to the conductor 32.

The conductor 32 is separated into a first conductor 321, a second conductor 322, and a third conductor 333 by the first and second LC parallel resonance circuits 331 and 332. The first LC parallel resonance circuit 331 is formed of a coil L31, which is an inductance element, and a capacitor C31, which is a capacitance element, which are connected in parallel. The second LC parallel resonance circuit 332 is formed of a coil L32, which is an inductance element, and a capacitor C33, which is a capacitance element, which are connected in parallel.

One end of the first conductor 321, which is one end of the conductor 32, is extended out on the end surface of the conductor 31, forming a power-supply section 35, and is connected to the power-feeding terminal 34. Further, the other end of the first conductor 321 is connected to one end of the coil L31 and a capacitor electrode 361 which forms a capacitor C31 inside the base 31.

Further, one end of the second conductor 322 is connected to the other end of the coil L31 and a capacitor electrode 371 which forms the capacitor C31 inside the base 11. The other end of the second conductor 322 is connected to one end of the coil L32 and a capacitor electrode 362 which forms the capacitor C32 inside the base 31.

Further, one end of the second conductor 323 is connected to the other end of the coil L32 and a capacitor electrode 372 which forms the capacitor C32 inside the base 11. The other end of the third conductor 322, which is the other end of the conductor 32, forms a free end 38 inside the base 31. With such a construction, the conductor 32 formed of the first, second, and third conductors 321 to 323, and the first and second LC parallel resonance circuits 331 and 332 are connected in series with each other.

In the chip antenna 30 with this construction, the conductor 32 resonates at the first frequency f1. With respect to the second frequency f2 at which the first LC parallel resonance circuit 331 resonates, the state is reached which is equivalent to that in which from the position of the conductor 32 at which the first LC parallel resonance circuit 331 is connected to the other end, that is, the second and third conductors 322 and 323, are opened. If the length from one end of the conductor 32 to the position at which the first LC parallel resonance circuit 331 is connected, that is, the length of the first conductor 321, is set so that the first conductor 321 resonates at the second frequency f2, the first conductor 321 resonates at the second frequency f2.

With respect to the third frequency f3 at which the second LC parallel resonance circuit 332 resonates, the state is reached which is equivalent to that in which from the position of the conductor 32 at which the second LC parallel resonance circuit 332 is connected to the other end, that is, the third conductor 323, is opened. If the length from one end of the conductor 32 to the position at which the second LC parallel resonance circuit 332 is connected, that is, the length such that the lengths of the first and second conductors 321 and 322 are added together is set so that the first and second conductors 321 and 322 resonate at the third frequency f3, the first and second conductors 321 and 322 resonate at the third frequency f3.

As a result, the chip antenna 30 can have as resonance frequencies the first frequency f1 corresponding to the length of the conductor 32, the second frequency f2 corresponding to the length of the first conductor 321, and the third frequency f3 corresponding to the length such that the lengths of the first and second conductors 321 and 322 are added together.

According to the chip antenna of the above-described third embodiment, since there is provided two LC parallel resonance circuits which are inserted into an intermediate portion of a conductor and which are connected electrically in series with each other, it is possible to realize an antenna having three different resonance frequencies by one chip antenna.

Figure 10:
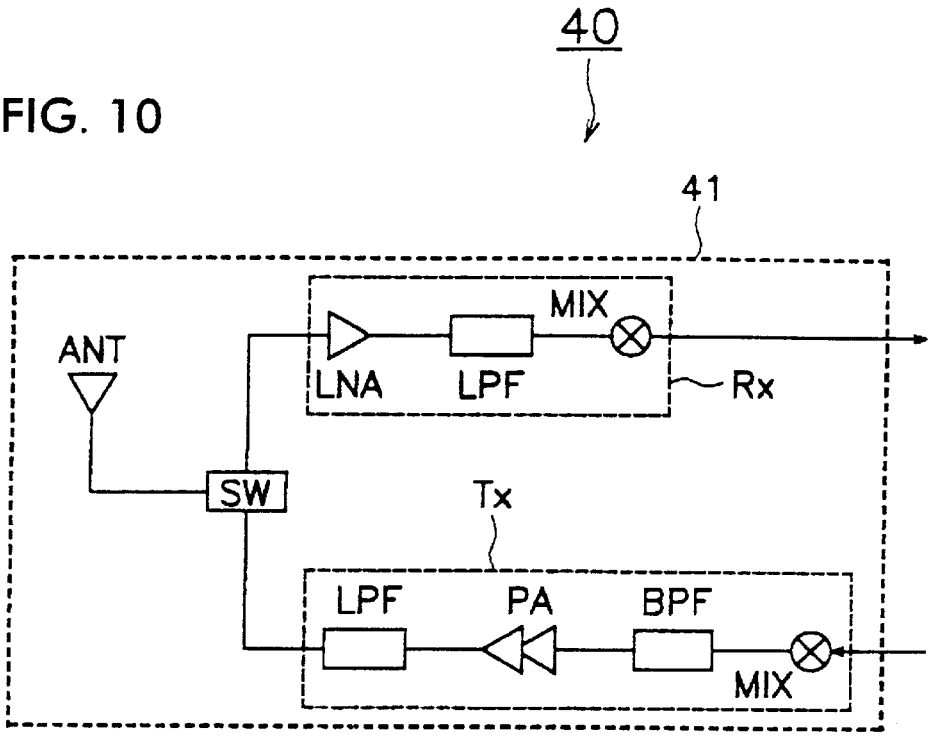
FIG. 10 is an RF block diagram of an ordinary mobile communication apparatus.
Figure 11:
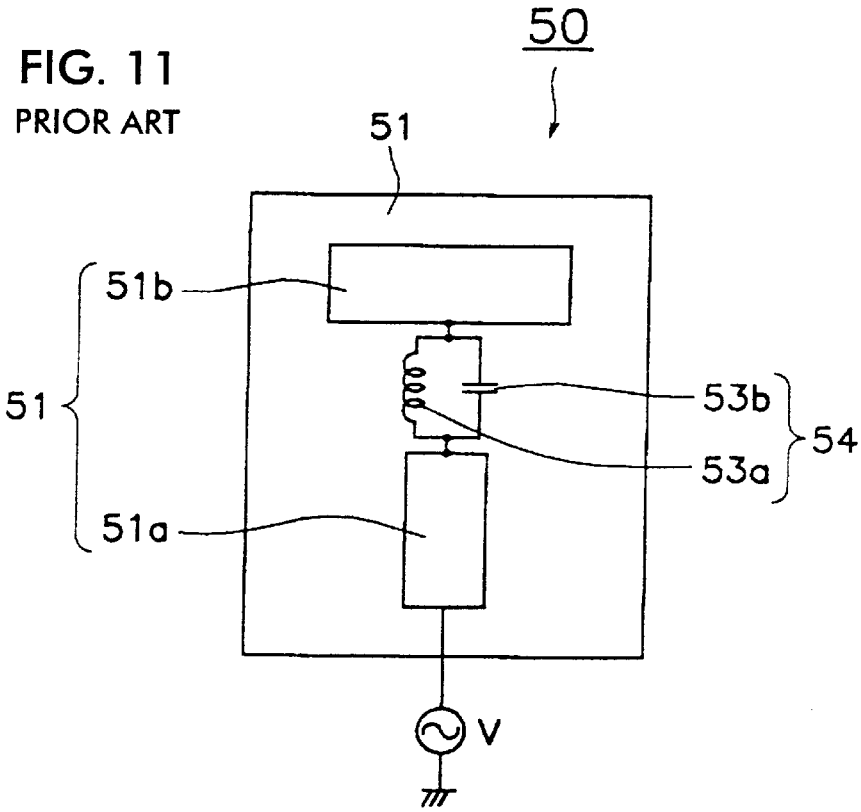
FIG. 11 PRIOR ART
FIG. 11 is a top plan view showing a conventional print antenna.

FIG. 10 shows an RF block diagram of a portable telephone set, which is an ordinary mobile communication apparatus. A portable telephone set 40 includes an antenna ANT, a transmission circuit Tx and a receiving circuit Rx, which are connected to the antenna ANT via a switch SW, and a housing 41 which covers the switch SW, and the transmission circuit Tx and the receiving circuit Rx.

The transmission circuit Tx comprises a low-pass filter LPF, a high-output amplifier PA, a band-pass filter BPF, and a mixer MIX, and the receiving circuit Rx comprises a low-noise amplifier LNA, a low-pass filter LPF, and a mixer MIX.

Therefore, it is conceivable to use the chip antennas 10, 10*a*, 10*b*, 20, and 30 shown in FIGS. 1, and 6 to 9 as the antenna ANT of the portable telephone set 40 shown in FIG. 10.

According to the portable telephone set of the above-described embodiment, since one chip antenna having a plurality of different frequencies is used as the antenna, it is possible for one antenna to perform transmission and reception of radio waves at a plurality of different frequencies. Therefore, it is possible to form the mobile communication apparatus into a smaller size.

Although in the above-described first to third embodiments a case is described in which a base is formed of a dielectric material having barium oxide, aluminum oxide, and silica as main constituents, the base is not limited to this dielectric material, and a dielectric material having titanium oxide, and neodymium oxide as main constituents, a magnetic material having nickel oxide, cobalt oxide, and iron oxide as main constituents, or a combination of a dielectric material and a magnetic material may be used.

Further, although a case is described in which one conductor is used, a plurality of conductors, which are disposed in parallel to each other, may be provided. In this case, it is possible to further increase the number of resonance frequencies according to the number of conductors.

In addition, although a case is described in which one or two anti-resonance circuits are connected in series with a conductor, and the chip antenna has two or three resonance frequencies, by connecting three or more anti-resonance circuits in series with the conductor, it is possible for the chip antenna to have four or more different resonance frequencies. As a result, when, for example, the chip antenna has four different resonance frequencies, it is possible for one chip antenna to transmit and receive radio waves of a plurality of mobile communication apparatuses, such as a pager, a PHS, and a portable telephone set.

Further, although in the first embodiment a case is described in which a capacitance element and an inductance element are disposed inside a base, a part thereof may be provided on both main surfaces of the base. For example, there is a method of providing one or a part of the capacitor electrodes which form the capacitance element or a part of coil electrodes which form the inductance element on both main surfaces of the base. In this case, since the part formed on the main surface of the base can be trimmed easily by a laser or the like, it is possible to easily adjust the frequency at which the anti-resonance circuit resonates and to improve the characteristics of the chip antenna.

While the invention has been particularly shown and described with reference to preferred embodiments thereof, it will be understood by those skilled man in the art that the forgoing and other changes in form and details may be made therein without departing from the spirit of the invention.

What is claimed is:

1. A chip antenna, comprising:

a base comprising at least one of a dielectric material and a magnetic material;

at least one conductor provided at least one of within the base and on the surface of the base;

and an anti-resonance circuit inserted in the intermediate portion of said conductor and electrically connected in series; and a power-feeding terminal provided on the surface of said base and electrically connected to one end of said conductor.

2. A chip antenna according to claim 1, wherein said anti-resonance circuit is an LC parallel resonance circuit comprising an inductance element and a capacitance element.

3. A chip antenna according to claim 1, wherein at least one of the inductance element and the capacitance element which constitutes said anti-resonance circuit may be a variable element.

4. A chip antenna according to claim 1, wherein said anti-resonance circuit is mounted within said base.

5. A mobile communication apparatus, comprising:

a chip antenna comprising a base comprising at least one of a dielectric material and a magnetic material, at least one conductor provided at least one of within the base and on the surface of the base, an anti-resonance circuit inserted in the intermediate portion of said conductor and electrically connected in series, and a power-feeding terminal provided on the surface of said base and electrically connected to one end of said conductor;

a transmission circuit connected to said chip antenna;

a receiving circuit connected to said chip antenna; and a housing which covers said chip antenna, said transmission circuit and said receiving circuit.

* * * * *